US010883331B2

(12) United States Patent
Douty et al.

(10) Patent No.: US 10,883,331 B2
(45) Date of Patent: Jan. 5, 2021

(54) BLOWOUT PREVENTER WITH INTERLOCKING RAM ASSEMBLY AND METHOD OF USING SAME

(71) Applicant: National Oilwell Varco, L.P., Houston, TX (US)

(72) Inventors: James A. Douty, The Woodlands, TX (US); Jeffrey Thomas Melancon, Willis, TX (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 213 days.

(21) Appl. No.: 16/066,329

(22) PCT Filed: Jan. 7, 2016

(86) PCT No.: PCT/US2016/012536
§ 371 (c)(1),
(2) Date: Jun. 27, 2018

(87) PCT Pub. No.: WO2017/119894
PCT Pub. Date: Jul. 13, 2017

(65) Prior Publication Data

US 2019/0010777 A1 Jan. 10, 2019

(51) Int. Cl.
*E21B 33/06* (2006.01)
*E21B 33/064* (2006.01)
*E21B 33/035* (2006.01)

(52) U.S. Cl.
CPC ..... *E21B 33/063* (2013.01); *E21B 33/0355* (2013.01)

(58) Field of Classification Search
CPC ..... E21B 29/08; E21B 33/063; E21B 33/062; E21B 33/064
USPC ..... 251/1.3
See application file for complete search history.

(56) References Cited

U.S. PATENT DOCUMENTS 3,235,224 A 2/1966 Grove
4,215,749 A 8/1980 Dare et al.
4,671,312 A 6/1987 Bruton
4,997,162 A 3/1991 Baker et al.
(Continued)

FOREIGN PATENT DOCUMENTS

CN 104790899 A 7/2015

OTHER PUBLICATIONS

PCT/US2016/012536 International Search Report and Written Opinion dated Sep. 8, 2016 (10 p.).
(Continued)

*Primary Examiner* — Kenneth L Thompson
(74) *Attorney, Agent, or Firm* — Conley Rose, P.C.

(57) ABSTRACT

A ram assembly is disclosed. The ram assembly includes a ram wedge, a blade, and a ram seat. The ram wedge has a tubular cavity therethrough for receiving the tubular. The ram wedge is slidably positionable in the ram channel between a retracted and an extended position, and has rails extending therefrom. The blade is positionable about the tubular cavity, the blade carried by the ram wedge to cuttingly engage the tubular. The ram seat is positionable in the housing about the passage, and has a hole for receiving the tubular therethrough. The ram seat also has an outer surface interlockingly engageable with the rails as the ram wedge moves relative thereto whereby a gap is reduced therebetween.

20 Claims, 12 Drawing Sheets

(56) References Cited

U.S. PATENT DOCUMENTS

| | | | | |
|---|---|---|---|---|
| 7,975,761 | B2 | 7/2011 | Berckenhoff et al. | |
| 8,070,131 | B2 * | 12/2011 | Liew | E21B 29/04 251/326 |
| 8,353,338 | B2 | 1/2013 | Edwards | |
| 9,249,643 | B2 * | 2/2016 | Melancon | E21B 33/063 |
| 2003/0029619 | A1 | 2/2003 | Sundararajan | |
| 2008/0135791 | A1 * | 6/2008 | Juda | E21B 33/062 251/1.3 |
| 2010/0319906 | A1 | 12/2010 | Van Winkle | |
| 2013/0119288 | A1 * | 5/2013 | Shaw | E21B 29/08 251/328 |
| 2014/0110611 | A1 * | 4/2014 | McClanahan | E21B 33/063 251/1.3 |
| 2014/0264099 | A1 | 9/2014 | Melancon | |
| 2016/0312904 | A1 * | 10/2016 | Hoang | E21B 29/08 |
| 2019/0277106 | A1 * | 9/2019 | Cowie | E21B 33/063 |

OTHER PUBLICATIONS

Brazilian Office Action dated Jun. 24, 2020, for Brazilian Application No. BR112018013531-3 (4 p.).
English Translation of Brazilian Office Action dated Jun. 24, 2020, for Brazilian Application No. BR112018013531-3 (2 p.).

* cited by examiner

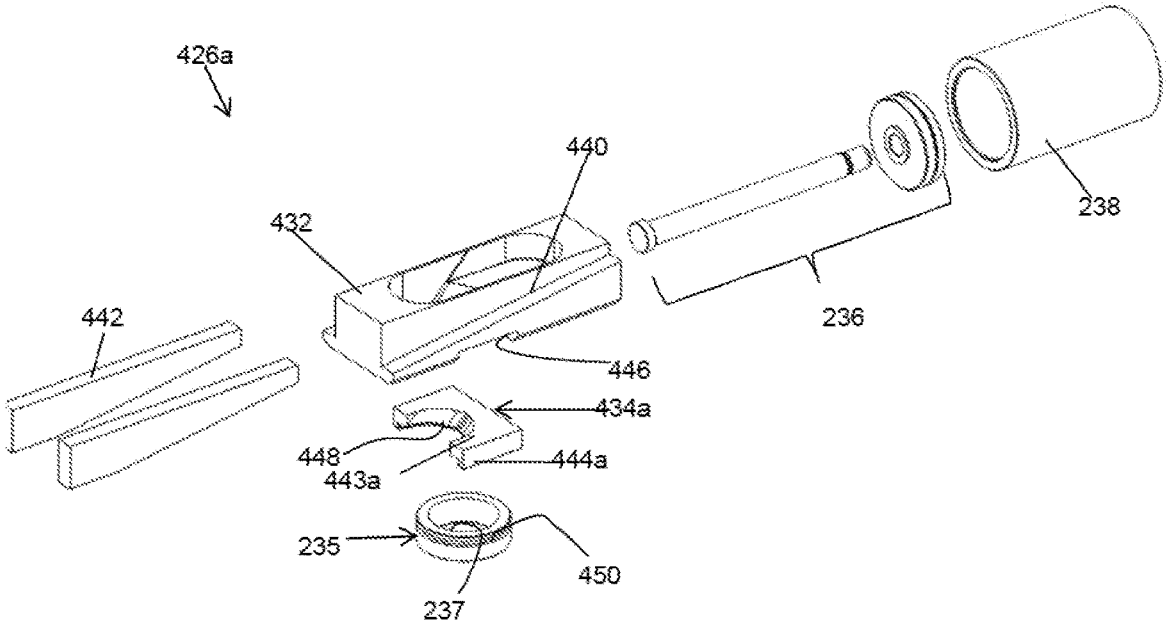
Figure 4A1
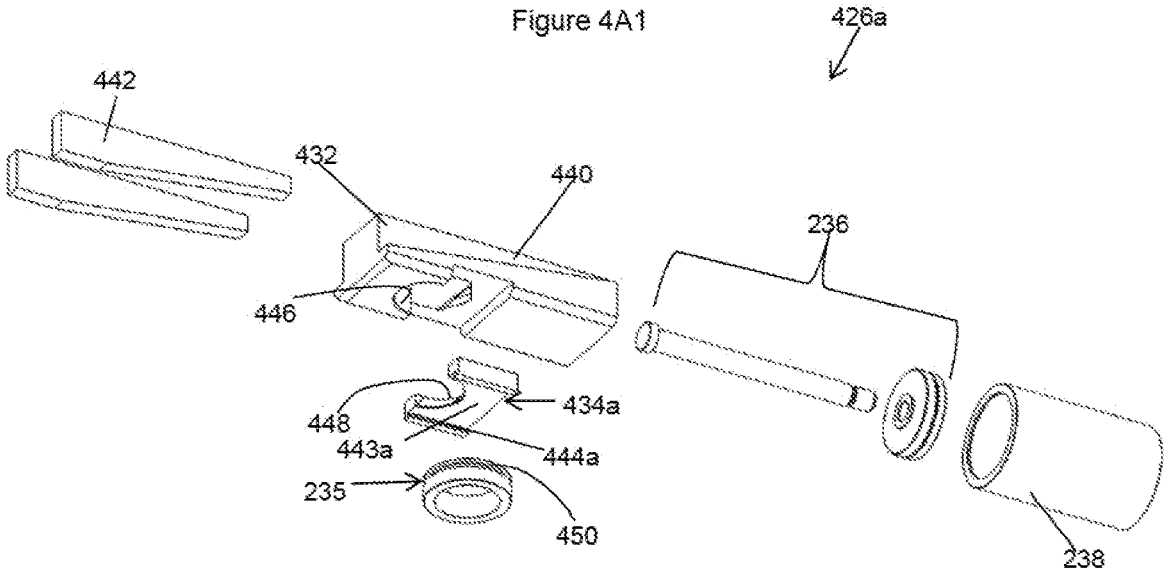
Figure 4A2

Figure 4B1
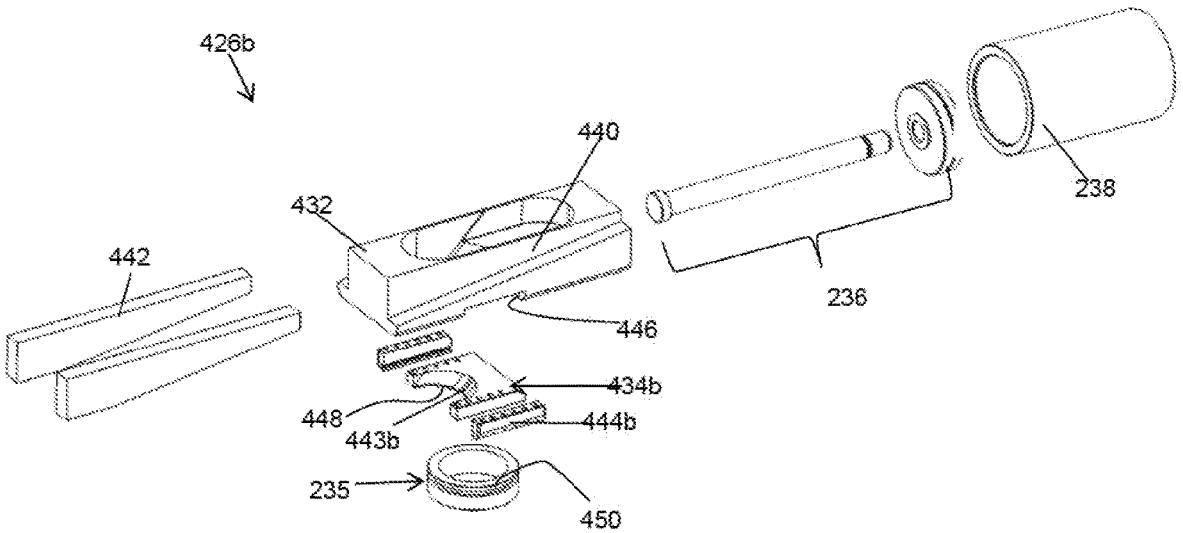
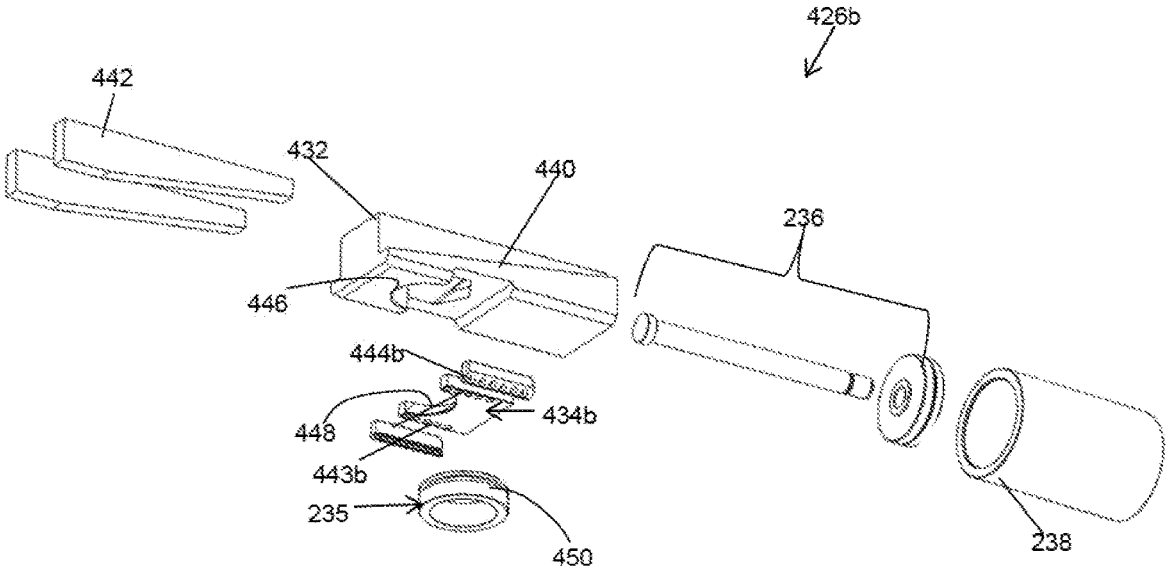
Figure 4B2

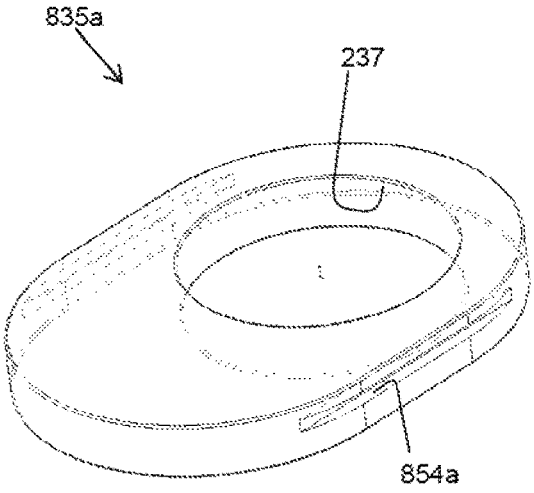
Figure 8A
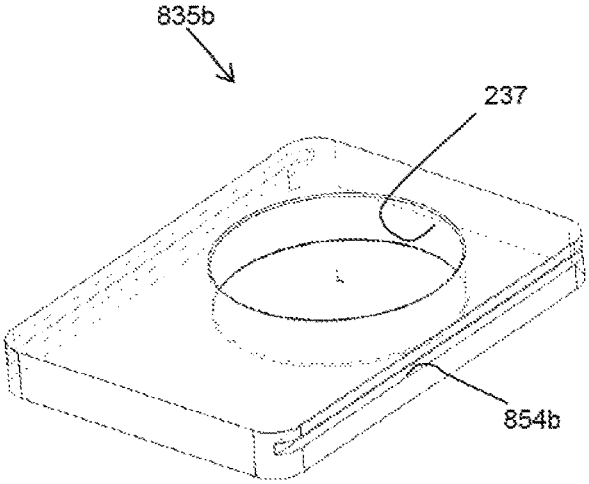
Figure 8B
Figure 9A
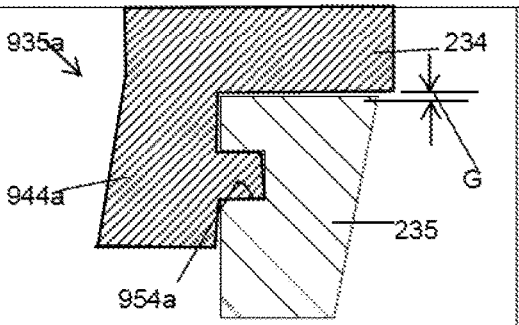
Figure 9B
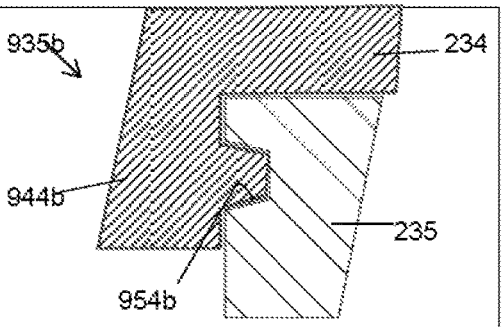
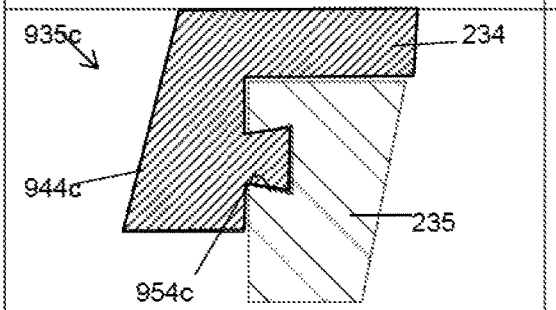
Figure 9C
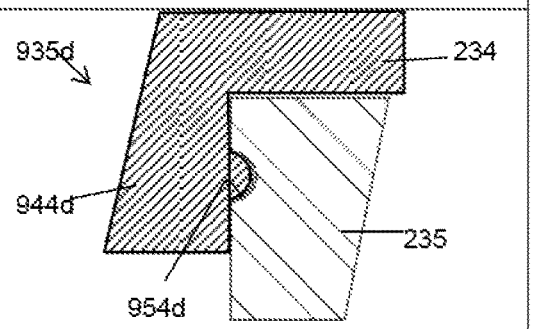
Figure 9D

BLOWOUT PREVENTER WITH INTERLOCKING RAM ASSEMBLY AND METHOD OF USING SAME

CROSS-REFERENCE TO RELATED APPLICATIONS

This application is a 35 U.S.C. § 371 national stage application of PCT/US2016/012536 filed Jan. 7, 2016, and entitled "Blowout Preventer with Interlocking Ram Assembly and Method of Using Same," which is incorporated by reference herein in its entirety for all purposes.

BACKGROUND

This present disclosure relates generally to techniques for performing wellsite operations. More specifically, the present disclosure relates to techniques for preventing blowouts involving, for example, severing a tubing and/or sealing a wellbore.

Oilfield operations may be performed to locate and gather valuable downhole fluids. Oil rigs are positioned at wellsites and downhole tools, such as drilling tools, are deployed into the ground to reach subsurface reservoirs. Once the downhole tools form a wellbore to reach a desired reservoir, casings may be cemented into place within the wellbore, and the wellbore completed to initiate production of fluids from the reservoir. Downhole pipes may be positioned in the wellbore to enable the passage of subsurface fluids to the surface.

Various devices may be used to prevent leakage of fluids about the wellsite. Equipment, such as blowout preventers (BOPs), may be positioned about the wellbore to form a seal about a tubing therein to prevent leakage of fluid as it is brought to the surface. BOPs may have rams, such as pipe rams or shear rams, that may be activated to seal and/or sever a tubing in a wellbore. Some examples of BOPs are provided in U.S. Patent/Application Nos. 2014/0264099, 2010/0319906, U.S. Pat. Nos. 3,235,224, 4,215,749, 4,671,312, 4,997,162, 7,975,761, and 8,353,338, the entire contents of which are hereby incorporated by reference herein.

The BOPs may be subject to harsh conditions and/or significant forces, such as wellbore pressure and mechanical forces, which may affect sealing. Despite advancements in BOP technology, there remains a need for techniques for properly sealing and preventing leakage of fluids about the BOP. The present disclosure is directed at providing such techniques.

SUMMARY

In at least one aspect, the disclosure relates to a ram assembly (e.g., of a blowout preventer for sealing a wellbore). The blowout preventer has a housing with a passage therethrough for receiving a tubular of the wellbore and a ram channel therethrough. The ram assembly comprises a ram wedge, a blade, and a ram seat. The ram wedge having a tubular cavity therethrough for receiving the tubular, is slidably positionable in the ram channel between a retracted and an extended position, and has rails extending therefrom. The blade positionable about the tubular cavity. The blade is carried by the ram wedge to cuttingly engage the tubular. The ram seat is positionable in the housing about the passage, has a hole for receiving the tubular therethrough, and has an outer surface interlockingly engageable with the rails as the ram wedge moves relative thereto whereby a gap is reduced therebetween.

The ram assembly further comprises a locking wedge positionable in the housing, the locking wedge having a surface engageable with a surface of the ram wedge. The locking wedge is fixed or movable. The ram wedge is one integral with or separate from the blade. The ram seat has a groove on the outer surface thereof engageable with the rails. The rails have tongues extending therefrom receivable by the grooves. The ram seat is circular or polygonal. The rails and the ram seat have a tongue and groove interface therebetween. The tongue and groove interface is rectangular, slanted, dovetail, and/or curved. The blade and the ram seat define a metal to metal seal therebetween.

In another aspect, the disclosure relates to a blowout preventer (e.g., for sealing a wellbore). The wellbore has a tubular extending therefrom for passing therethrough. The blowout preventer comprises a housing having a passage for receiving the tubular and a ram channel therethrough, and at least one ram assembly. The ram assembly comprises a ram wedge, a blade, and a ram seat. The ram wedge having a tubular cavity therethrough for receiving the tubular, is slidably positionable in the ram channel between a retracted and an extended position, and has rails extending therefrom. The blade positionable about the tubular cavity. The blade is carried by the ram wedge to cuttingly engage the tubular. The ram seat is positionable in the housing about the passage, has a hole for receiving the tubular therethrough, and has an outer surface interlockingly engageable with the rails as the ram wedge moves relative thereto whereby a gap is reduced therebetween.

The blowout preventer further comprises actuators to extend and retract the ram wedge, and at least one controller.

Finally, in another aspect, the disclosure relates to a method (e.g., for sealing a wellbore). The wellbore has a tubular extending therefrom for passing therethrough. The method comprises providing a blowout preventer comprising a housing having a passage and a ram channel therethrough and at least one ram assembly. The ram assembly comprises a ram wedge, a blade, and a ram seat. The ram wedge having a tubular cavity therethrough for receiving the tubular, is slidably positionable in the ram channel between a retracted and an extended position, and has rails extending therefrom. The blade positionable about the tubular cavity. The blade is carried by the ram wedge to cuttingly engage the tubular. The ram seat is positionable in the housing about the passage, has a hole for receiving the tubular therethrough, and has an outer surface interlockingly engageable with the rails as the ram wedge moves relative thereto whereby a gap is reduced therebetween. The method further involves positioning the tubular through the passage, the tubular cavity and the hole, and forming a seal between the ram seat and the ram wedge by moving a ram shuttle and the ram wedge to the extended position.

BRIEF DESCRIPTION OF THE DRAWINGS

So that the above recited features and advantages of the present disclosure can be understood in detail, a more particular description of the invention, briefly summarized above, may be had by reference to the embodiments thereof that are illustrated in the appended drawings. It is to be noted, however, that the appended drawings illustrate example embodiments and are, therefore, not to be considered limiting of its scope. The figures are not necessarily to scale and certain features, and certain views of the figures may be shown exaggerated in scale or in schematic in the interest of clarity and conciseness.

FIGS. 4A1 and 4A2 are exploded views of another interlocking ram assembly with a ram wedge.

FIGS. 4B 1 and 4B2 are exploded views of another interlocking ram assembly with a ram wedge and a modular blade.

FIGS. 8A and 8B are perspective views of various seat configurations.

FIGS. 9A-9D are partial cross-sectional views depicting various interlocking configurations of the blade and the seat.

DETAILED DESCRIPTION

The description that follows includes exemplary apparatus, methods, techniques, and/or instruction sequences that embody techniques of the present subject matter. However, it is understood that the described embodiments may be practiced without these specific details.

A blowout preventer (BOP) with an interlocking ram assembly is provided for sealing a wellbore. The blowout preventer includes a housing with a passage to receive tubing therethrough and a seat positioned in the housing about the passage. The blowout preventer has a channel for receiving the ram assembly. The ram assembly includes a ram slidably positionable in the channel, and a blade engageable with tubing in the passage. The blade may be used to sever the tubing and/or to seal the passage (and thereby the wellbore).

The ram may have a single or dual wedge configuration which slidably moves through the BOP to carry the blade as it severs the tubing. The blade is interlockingly engageable with the seat using, for example, a tongue and groove connection (or interface) therebetween. The interlocking engagement between the blade and the seat may be used to guide the blade as it is carried by the ram. The interlocking engagement may also be used to maintain the blade against the seat and/or to minimize a gap therebetween, even in the presence of high pressure applied to one or both sides of the blade. The interlocking engagement may also be used, for example, in an attempt to maintain a position of the blade, to control the position of the blade during severing, to prevent leakage between the blade and the housing, to resist the force of pressure in the passage against the blade, to reduce wear over time, to allow for less precise design tolerance of the rams/blades, to maintain a metal-to-metal seal between the blade and the seat, etc.

"Tubing" as used herein relates to various devices extendable through the passage of the blowout preventer, such as pipes, certain downhole tools, casings, drill pipe, liner, coiled tubing, cable, mono/braided wire, production tubing, wireline, slickline, drill collars, landing strings, tool joints, tubulars, and/or other tubing and/or tubular members positioned in the wellbore, and associated components, such as drill bits, logging tools, packers, devices carried by the tubings, and the like.

Figure 1:
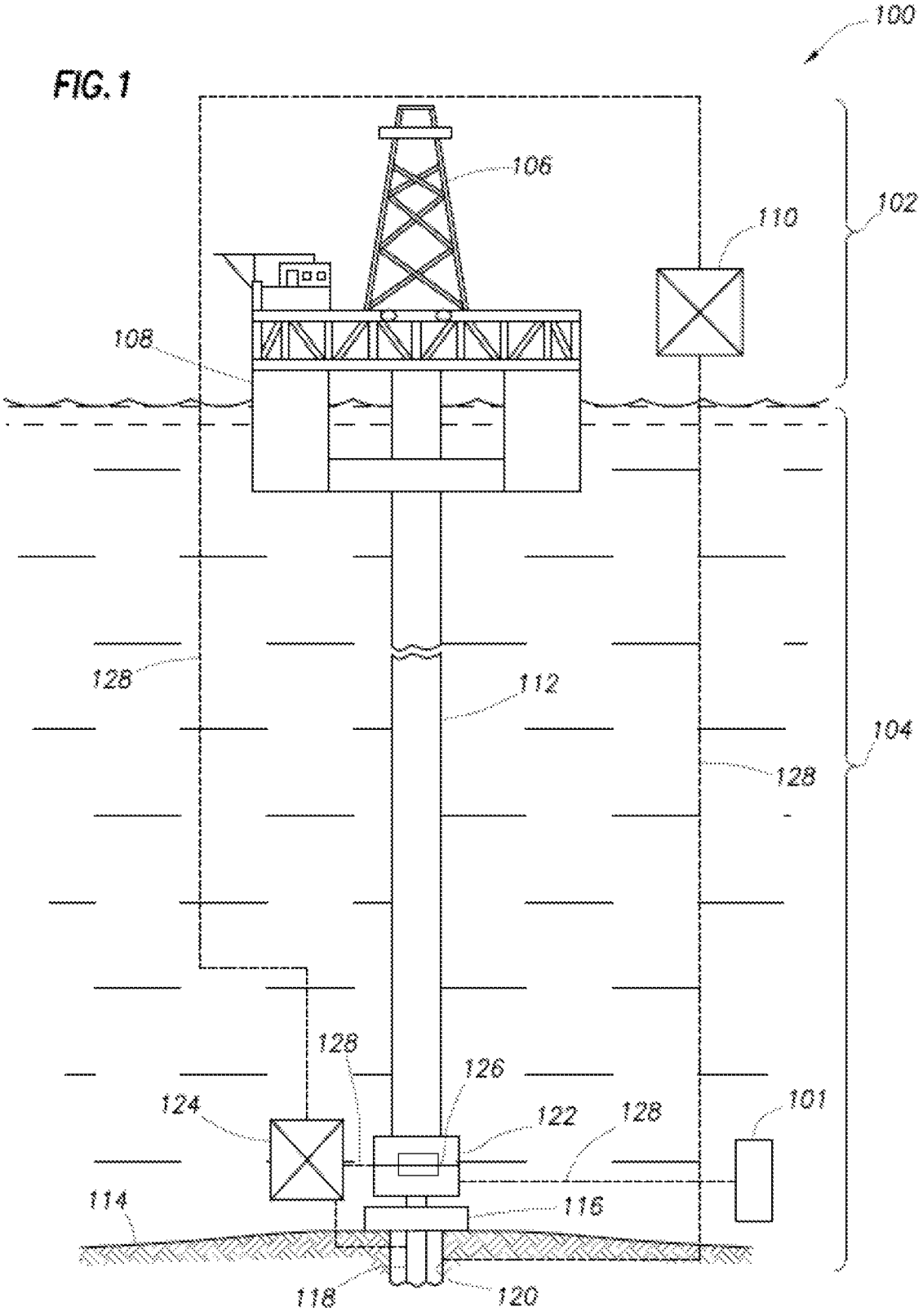
FIG. 1 depicts a schematic view of an offshore wellsite having a blowout preventer (BOP) with an interlocking ram assembly.

FIG. 1 depicts an offshore wellsite 100 with a BOP monitoring system 101. While an offshore wellsite is depicted, the wellsite 100 may be land based. The wellsite 100 has a surface system 102 and a subsea system 104. The surface system 102 may include a rig 106, a platform 108 (or vessel), and a surface unit 110. The surface unit 110 may include one or more units, tools, controllers, processors, databases, etc., located at the platform 108, a separate vessel, and/or near to or remote from the wellsite 100.

The subsea system 104 includes a conduit 112 extending from the platform 108 to a sea floor 114. The subsea system 104 further includes a wellhead 116 with a tubing 118 extending into a wellbore 120, a BOP 122 and a subsea unit 124. As shown, the BOP 122 has an interlocking ram assembly 126 for shearing and/or sealing about the tubing 118 to seal the wellbore 120. One or more BOPs 122, interlocking ram assemblies 126, and/or associated equipment may be provided. The interlocking ram assembly 126 is interlockingly engageable with a seat in the BOP as is described further herein.

The surface system 102 and subsea system 104 may be provided with one or more units, such as surface unit 110 and/or subsea unit 124, located at various locations to control the surface system 102 and/or the subsea systems 104. Communication links 128 may be provided for communication between the units and various parts of the wellsite 100. The BOP monitoring unit 101 may monitor operation of the BOP 122 and collect data therefrom. This data may be communicated to the various units.

Figure 2A:
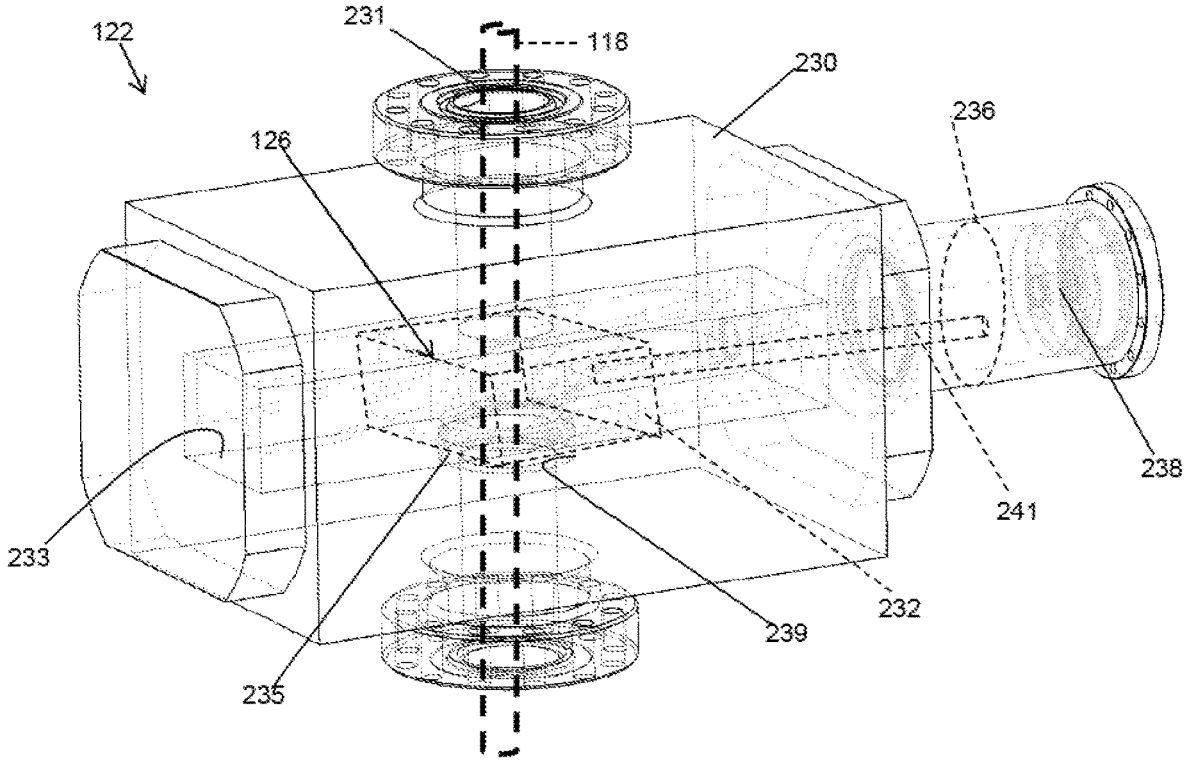
FIGS. 2A-2B are perspective views of the BOP having the interlocking ram assembly therein, the interlocking assembly having a slidable ram, a blade, and an interlocking seat.
Figure 2B:
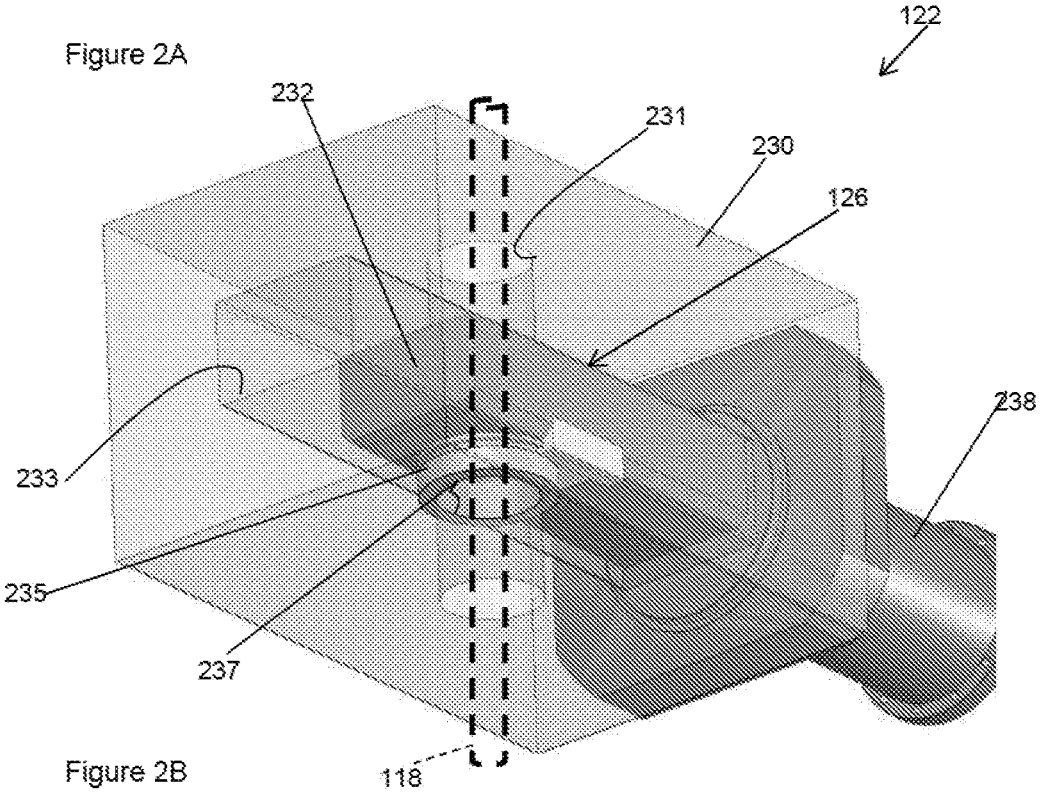
Figure 3A:
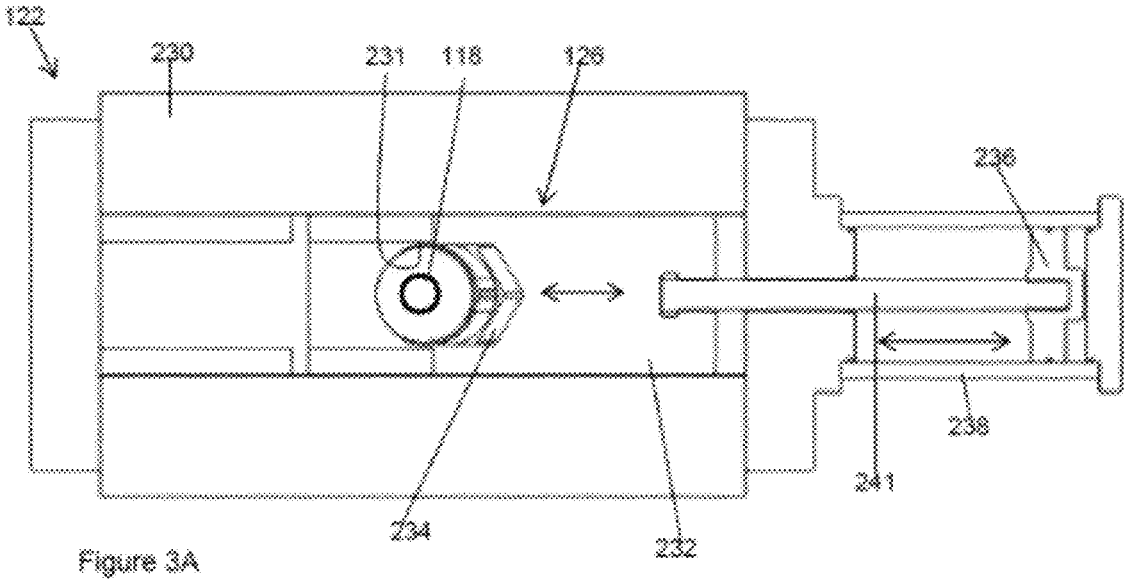
FIGS. 3A and 3B are horizontal and longitudinal cross-sectional views, respectively, of the BOP of FIG. 2 A.
Figure 3B:
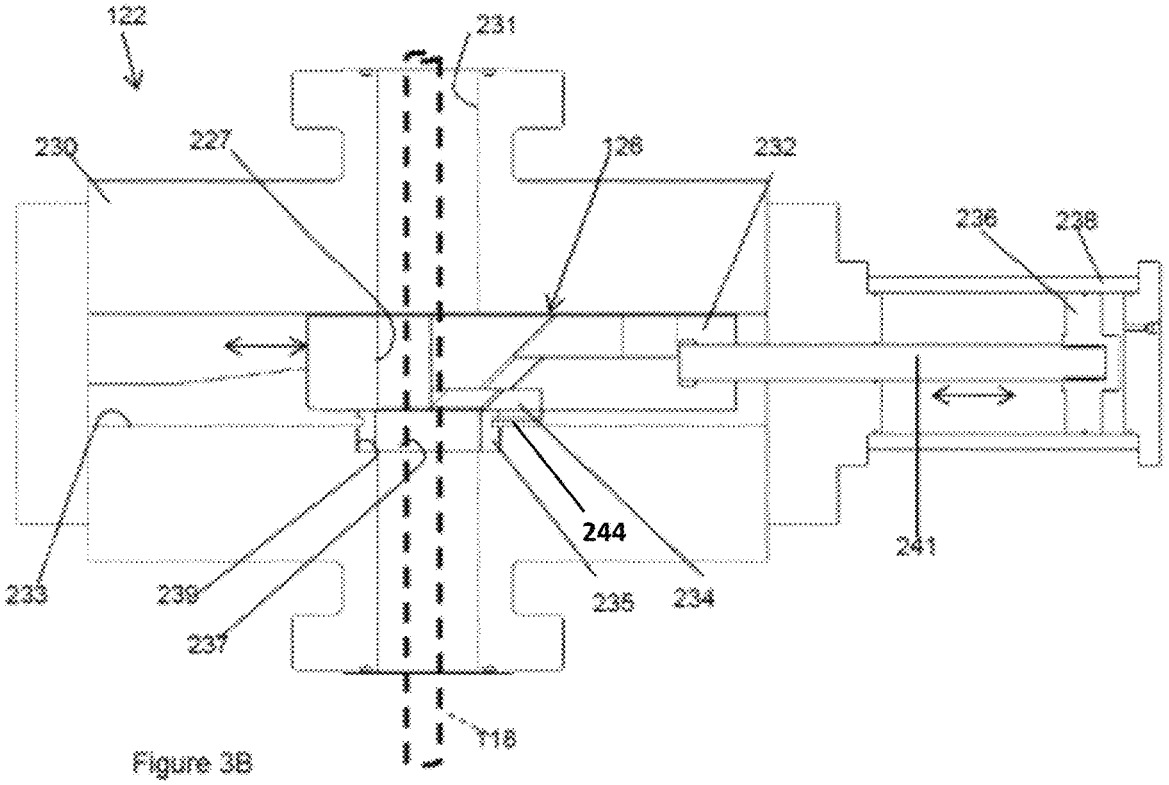
Figure 5A:
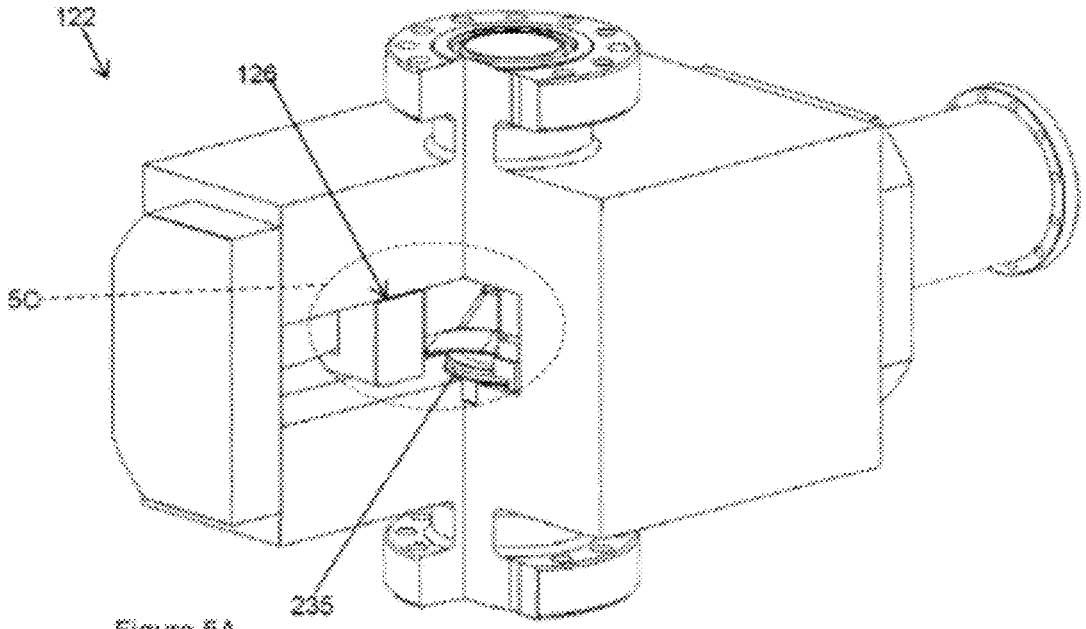
FIGS. 5 A and 5B are partial cross-sectional views of the BOP with the interlocking ram assembly.
FIG. 5C is a detailed view of a portion 5C of the BOP of FIG. 5 A.
Figure 5C:
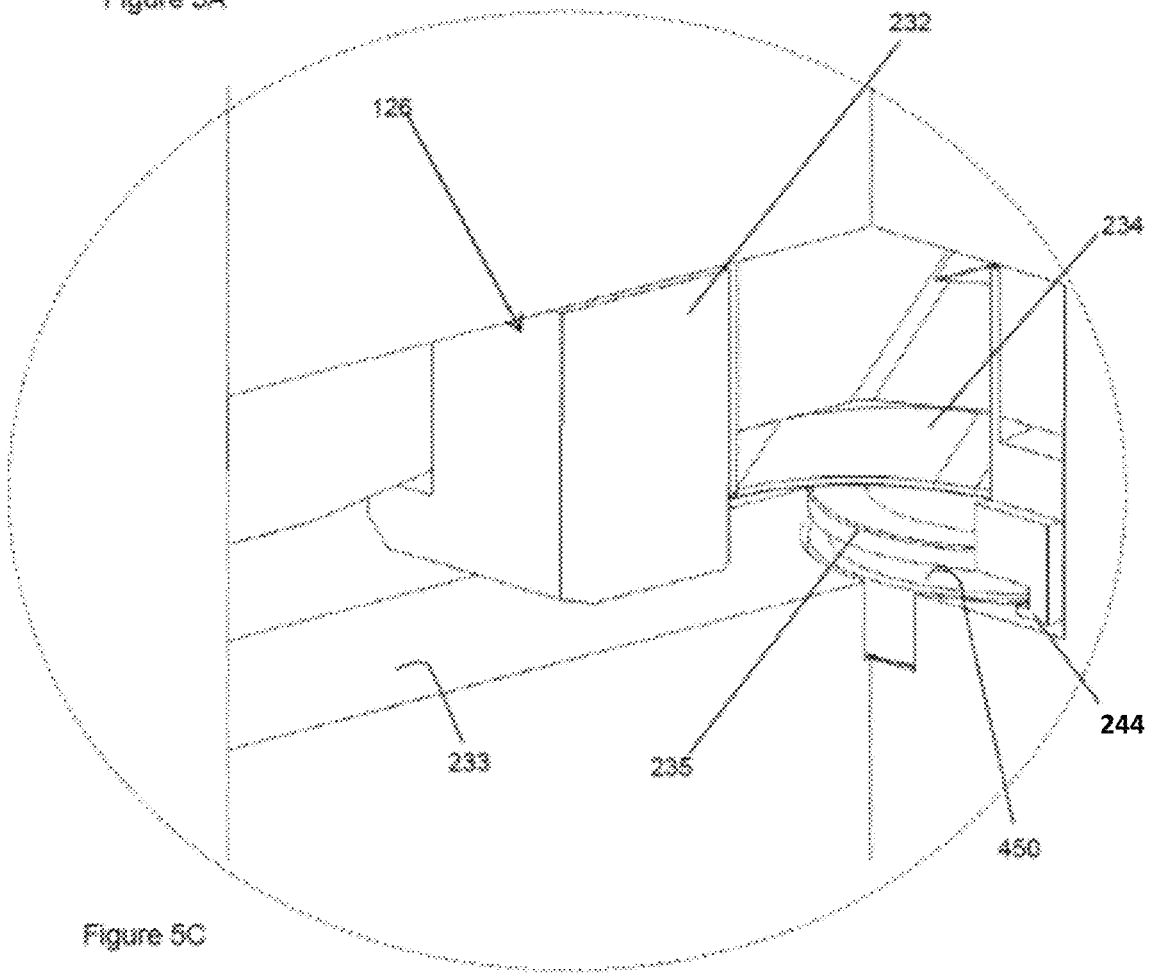
Figure 5B:
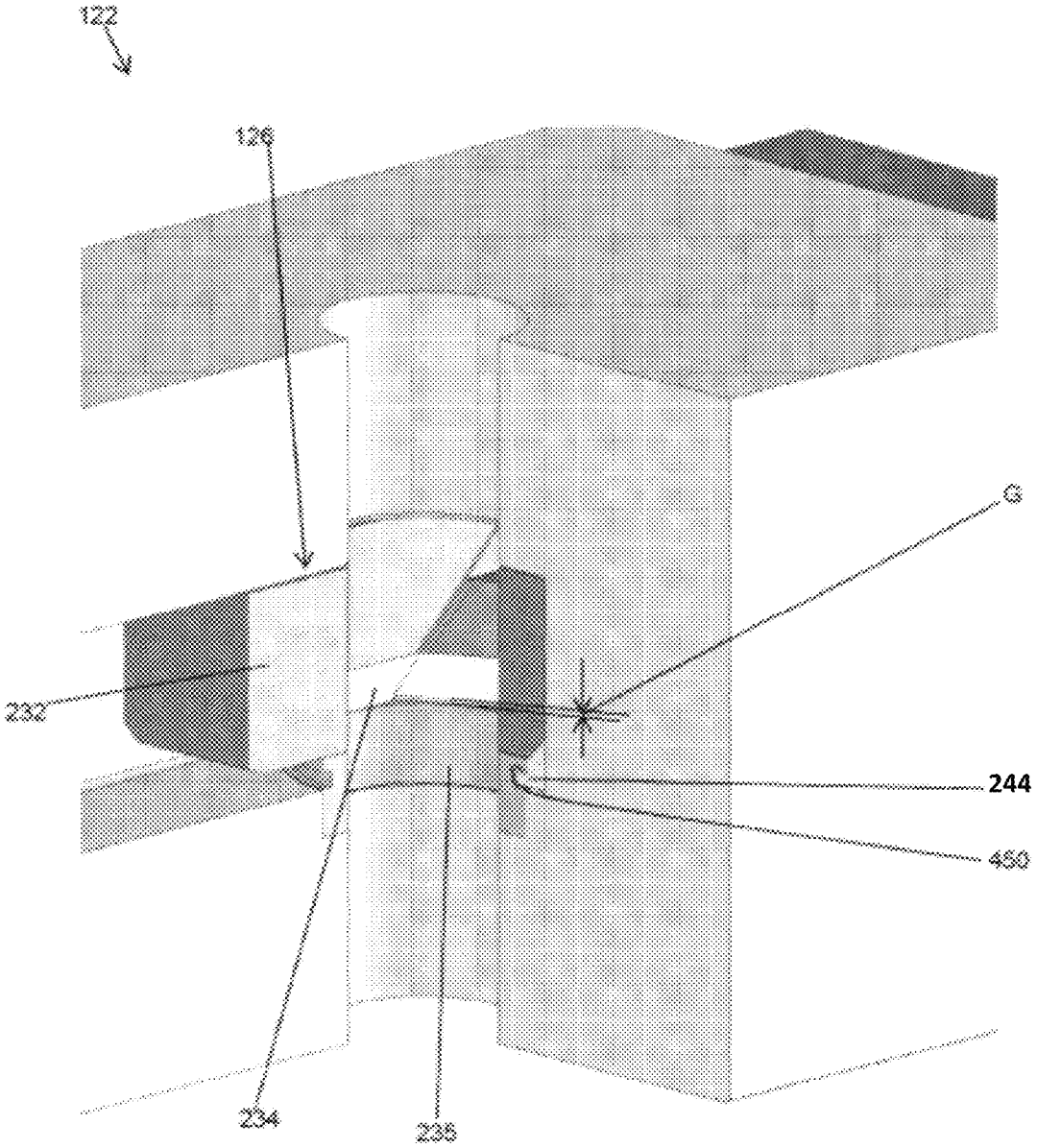
Figure 6A:
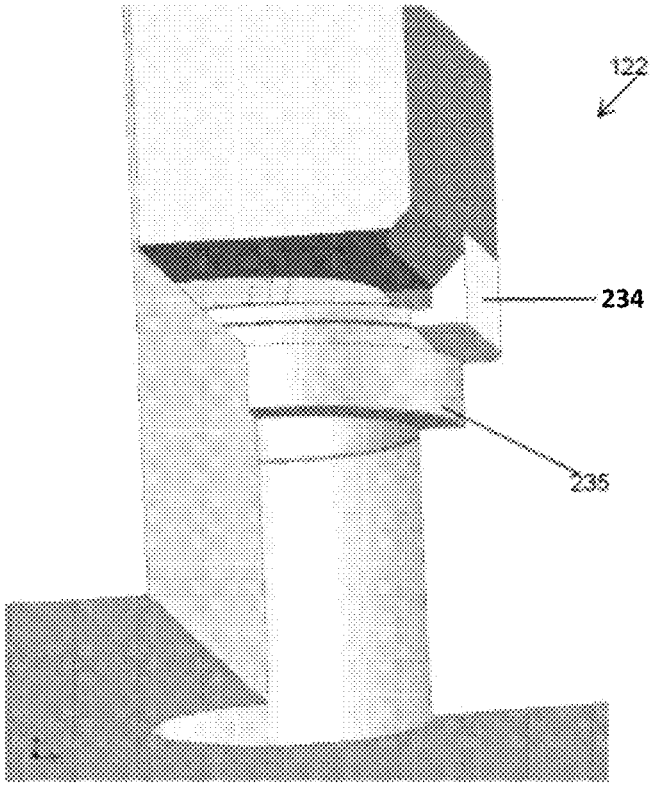
FIGS. 6A and 6B are partial cross-sectional views of portions of the BOP of FIG. 5A.
Figure 6B:
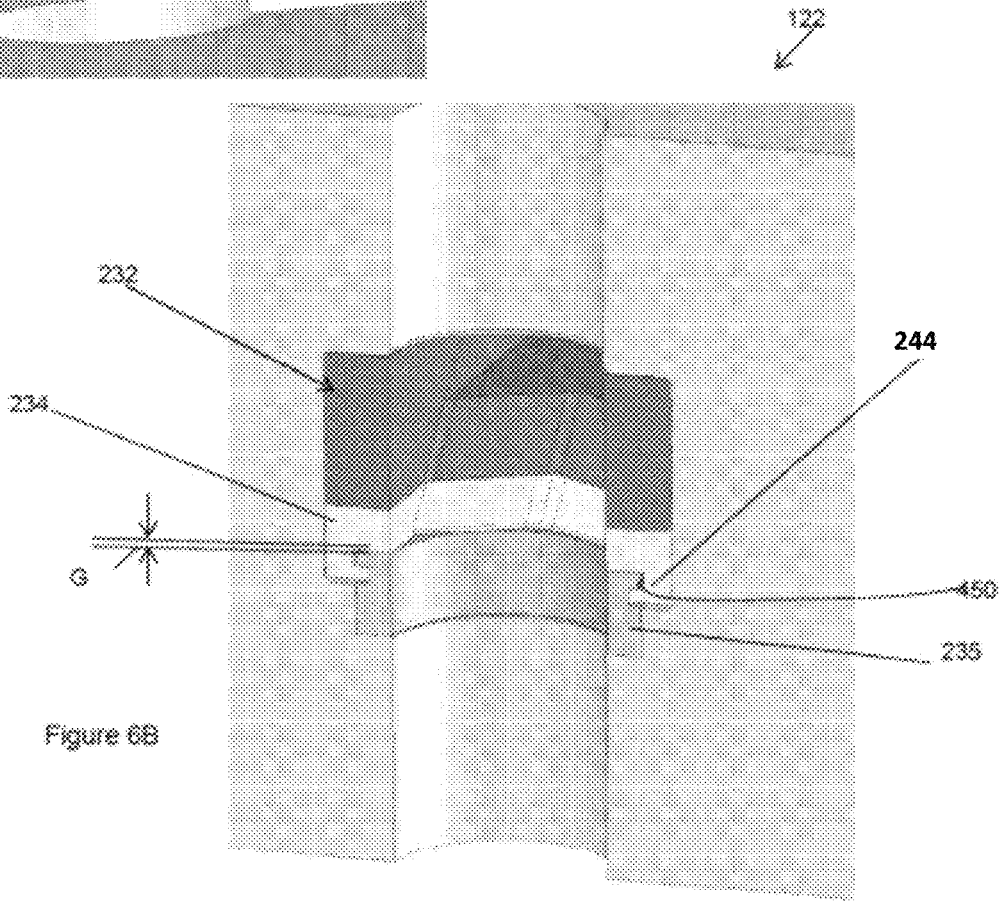

FIGS. 2A-3B depict various views of the BOP 122. FIGS. 2A and 2B are perspective views of the BOP 122. FIGS. 3A and 3B are horizontal and longitudinal cross-sectional views of the BOP 122. The BOP 122 includes a housing 230 with the interlocking ram assembly 126 therein. The tubing 118 is positioned in a passage 231 extending vertically through the BOP 122 and a channel 233 extending horizontally through the BOP 122. The horizontal channel 233 intersects the vertical passage 231 and is in selective fluid communication therewith.

The housing 230 also has a pocket 239 disposed about the passage 231 adjacent the channel 233. A seat 235 is disposed in the pocket 239. The seat 235 has a hole 237 to receive the tubing 118 therethrough. Seals (or gaskets) may optionally be provided to seal the seat 235 in the housing 230. The seat 235 may be integrally formed with the housing 230, or removable therefrom.

The interlocking ram assembly 126 is slidably positionable in the channel 233 of the BOP 122. The interlocking ram assembly 126 includes a ram 232, an interlocking blade 234, a ram piston 236, and a cylinder 238. The ram 232 is operatively connectable to the piston 236 by a rod 241 driven by pressure in the cylinder 238.

In this example, the ram 232 is extendable and retractable in the channel 233 such that the blade 234 engages the tubing 118 as the ram extends through the channel 233. The ram 232 has the hole 227 to receive the tubing 118 therethrough, and the blade 234 is adjacent the hole 237 to cut the tubing 118 as the ram 232 is advanced along the BOP 122. The blade 234 as shown has an inclined surface with a sharp edge to cuttingly engage the tubing 118. The blade 234 pinches tubing 118 between the blade 234 and the seat 235 to provide a guillotine configuration that severs the tubing 118 as the ram 232 moves to a cut position in the BOP 122. Examples of rams with guillotine capabilities are disclosed in US 2010/0319906, previously incorporated by reference herein.

The blade 234 has a flat body with a surface co-planar with a bottom surface of the ram 232. The bottom surface of the blade 234 and the ram 232 slide through the housing along the channel 233. The blade 234 is carried by the ram 232 and includes rails 244 to interlockingly engage with a seat 235 in the housing 230 during operation as is described further herein. While one ram assembly 126 of a certain configuration is depicted in one BOP housing 230, one or more ram assemblies 126 of various configurations may be positioned in one or more channels 233 in one or more BOP housings 230.

FIGS. 4A1-4B2 are exploded perspective views depicting additional example configurations of the interlocking ram assembly. As shown in these figures, various configurations of rams and/or blades may be used. FIGS. 4A1-A2 show a ram assembly 426*a* with a ram wedge 432 with a removable blade 434*a*. FIGS. 4B 1-B2 show a ram assembly 426*b* with the ram wedge 432 and a modular blade 434*b*. The ram wedge 432 is similar to the ram 232 of FIGS. 2A-3B, except that the ram wedge 432 has an incline 440 engageable with a fixed locking wedge 442, and a removable blade 434*a,b*. In the example shown, the wedge 442 may be positioned (e.g., fixed) in the BOP housing 230.

As shown in FIGS. 4A1-4A2, the ram 432 has a pocket 446 to receive the removable blade 434*a*. The blade 434*a* has a flat body 443*a* with a curved inlet 448 extending therein and shaped to conform to the hole 237 of the ram 432. In the version of FIG. 4A1-4A2, the blade 434*a* is unitary and removable from the ram 432, but may optionally be integrated therein.

The blade 434*a* has rails 444*a* extending below the flat bottom thereof. The rails 444*a* are linear members on opposite sides of the blade. The rails 444*a* have keys interlockingly engageable with the seat 235. The seat 235 is shown as a tubular member with grooves 450 about a periphery of the seat 235 to interlockingly engage the rails 444*a* of the blade 434*a*. The blade 434*a* and the seat 235 may be made of a metal material for metal-to-metal sealing therebetween. Optionally, coatings (e.g., hardeners) may be applied to the blade 434*a* and/or seat 235.

FIGS. 4B1-4B2 are similar to FIGS. 4A1-4A2, except that the blade 434*b* is modular. In this version, the blade 434*b* has a flat body 443*b* with removable rails 444*b*. While the rails 444*b* are depicted as linear portions with radially extended edges separable from the body 443*b*, various portions of the blade and/or ram may optionally be modular or integral.

FIGS. 5A-6B show additional views of the BOP 122 depicting engagement of the ram assembly 126 with the seat 235. As shown in these views, the blade 234 of the ram 232 interlockingly engages the seat 235 as the ram 232 passes through the channel 233. In this configuration, the blade 234 is urged against the seat 235 to maintain the metal-to-metal seal therebetween. This interlocking engagement may define a sliding, interlocking connection between the blade 234 and the seat 235.

The rails 244 of the blade 234 engage with the grooves 450 of the seat 235 to guide the ram 232 as it passes through the channel 233. This interlocking engagement may also be used to maintain a position of the blade 234 against the seat 235. The position of the blade 234 may be maintained such that a gap G is minimized to prevent leakage therebetween and/or to maintain the position of the blade 234.

Figure 7A:
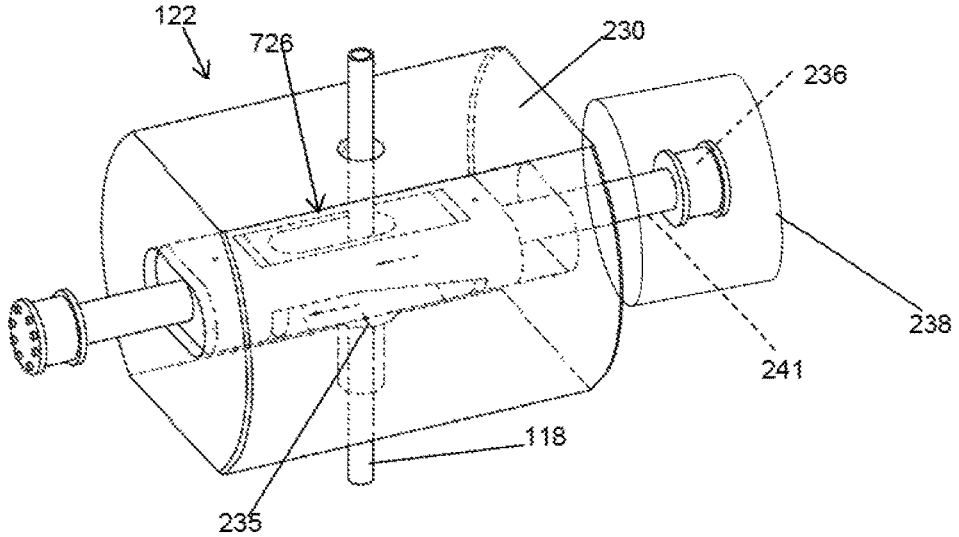
FIGS. 7A-7C show the BOP with another interlocking ram assembly having dual wedges.
Figure 7B:
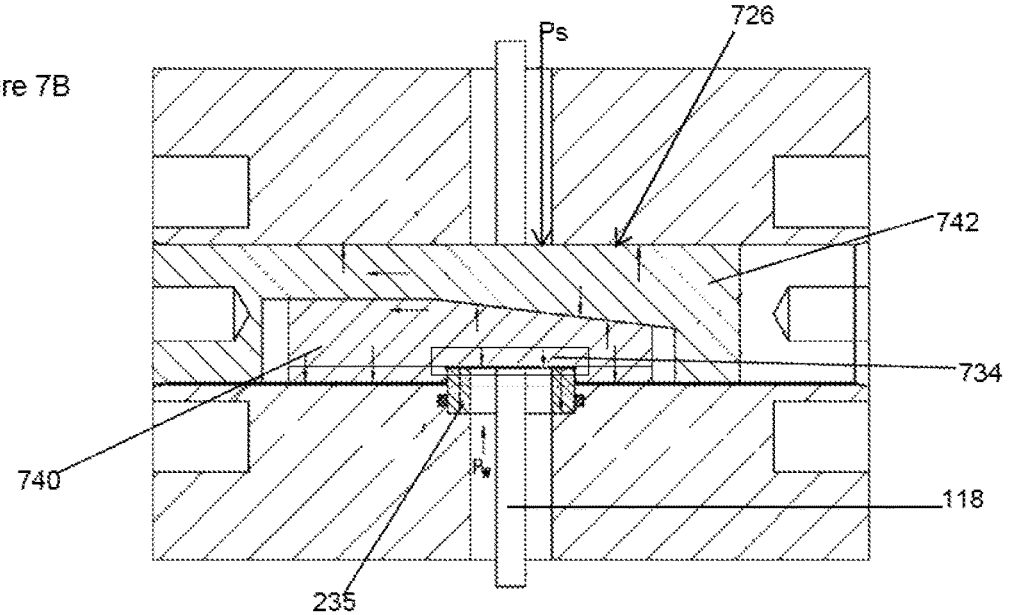
Figure 7C:
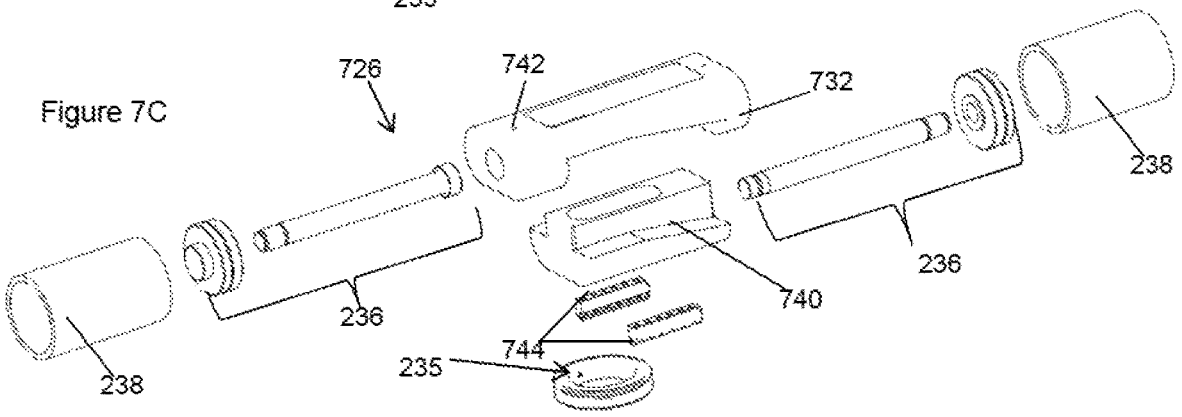

FIGS. 7A-7C show another configuration of the BOP having an interlocking ram assembly 726 in a dual wedge configuration. The BOP may be the same as the BOP 122 of FIGS. 1-3B and 5A-6B with the dual wedge interlocking ram assembly 726 therein. Examples of ram assemblies that may be used and possible variations are disclosed in US 2014/0264099, previously incorporated by reference herein.

The ram assembly 726 as shown in these figures is similar to those of FIGS. 4A1-4B2, except that the ram wedge 432 has been replaced with a modified ram wedge 732, and the fixed wedge 442 has been replaced with a movable locking wedge in the form of a movable ram shuttle 742. The ram wedge 732 is similar to the ram wedge 432, except that the incline 440 has been modified to have a different shape with an incline 740 having two slopes. Like the ram wedge 732, the ram shuttle 742 is an extendable and retractable by movement of a ram piston 236 and cylinder 238.

The ram shuttle 742 is extendable to slidingly engage the ram wedge 732. The ram wedge 732 is also extendable to slidingly engage the ram shuttle 742. The extension of one or both of the ram shuttle 742 and the ram wedge 732 for advancing the blade 734 carried by the ram wedge 732 for severing the tubing 118. The ram wedge 732 is provided with rails 744 engageable with the ram seat 235. The rails 744 may be connected with the blade 734 to support the blade in the ram wedge 732.

As shown by the horizontal arrows, the ram shuttle 742 may drive and support the and ram wedge 732 as it advances to sever the tubing 118 with blade 734. The blade 734 interlockingly engages the ram seat 235 with the rails 744 as it slidingly advances to sever the tubing 118. The interlocking engagement may be used to support the ram shuttle 742 and ram wedge 732 despite the presence of pressure, such as wellbore pressure Pw from the wellbore below the BOP 122 and/or pressure Ps from above the BOP 122.

FIGS. 8 A and 8B are perspective views of example seats 835*a,b* usable as the seat 235. Seat 835*a* is depicted as having an elliptical shape with grooves 854*a* on opposite sides extending a partial length thereof. The seat 835*b* is depicted as having a polygonal shape with grooves 854*b* on opposite sides extending the length thereof. The pocket 239 of the housing 230 of the BOP 122 may be shaped to receive the seats 835*a,b* (FIGS. 2A and 2B). The circular hole 237 extends through the seats 835*a,b* to receive the tubing 118 therein. As demonstrated by these views, the seats 235 may be of any shape positionable in the housing 230 of the BOP 122 and engageable with the blade for cutting the tubing 118 and/or sealing the BOP 122.

FIGS. 9A-9D show portions of the blade 234 and seat 235 with various configurations of interlocking engagement between the blade 234 and the seat 235. FIG. 9A shows embodiment 935*a* with a square rail 944*a* and groove 954*a*. The rail 944*a* may have a key (or tongue) extending therefrom for receipt in the groove 954*b*. FIG. 9B shows embodiment 935*b* with a slanted rail 944*b* with a slanted (or tapered) key and groove 954*b*. FIG. 9C shows embodiment 935*c* with a rail 944*c* with a dovetail key and groove 954*c*. FIG. 9D shows embodiment 935*d* with a rail 944*d* with a round key and groove 954*d*.

As demonstrated by these figures, any shape of interlocking engagement may be provided, such as a tongue and groove interface having a rectangular, slanted, dovetail, curved, and/or other shape. While the interlocking engagement is depicted as tongue and groove configuration, it will be appreciated that the blade and/or rails may have any shape to provide interlocking engagement between the blade and the seat such that the blade may slide relative to the seat while maintaining the blade against the seat and/or reducing the gap G therebetween.

Figure 10A:
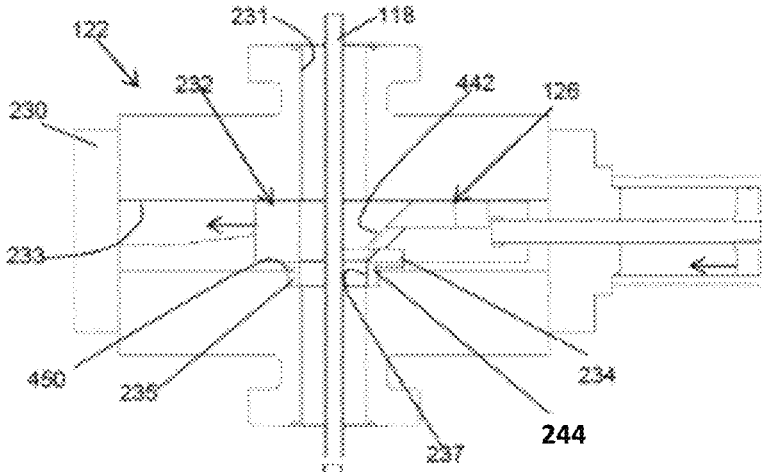
FIGS. 10A-10C are schematic longitudinal cross-sectional views of the BOP of FIG. 3 with the interlocking ram assembly in various positions during operation.
Figure 10B:
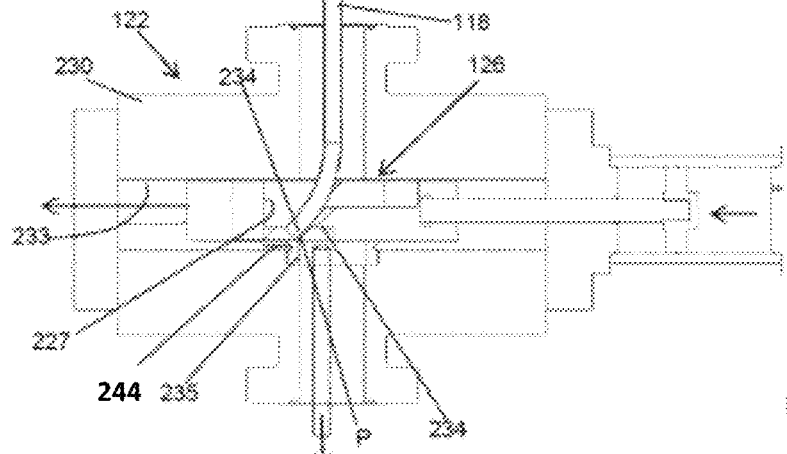
Figure 10C:
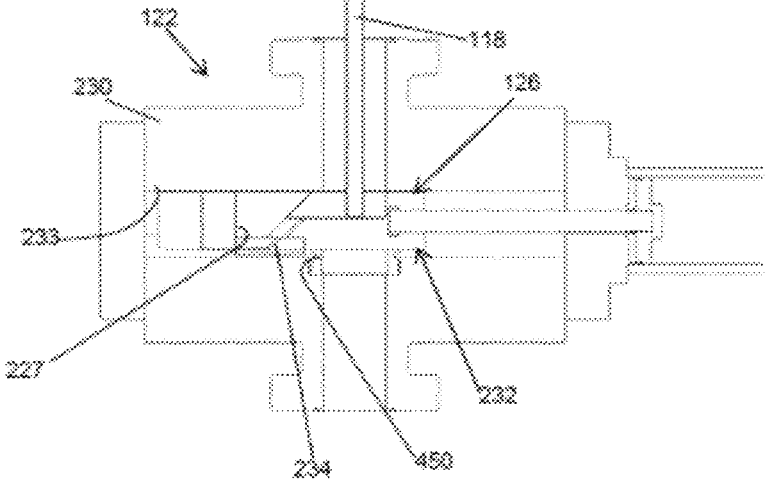

FIGS. 10A-10C depict the BOP 122 in various stages of operation. FIG. 10A shows the BOP 122 before activation. FIG. 10B shows the BOP 122 during activation. FIG. 10C shows the BOP 122 after activation. The ram assembly 126 is slidingly positionable in the BOP housing 230 during these stages.

In FIG. 10A, the ram assembly 126 is in the retracted position with the hole 227 in the ram 232 aligned with passage 231 of the housing 230. Tubing 118 extends through the housing 230, hole 227 of the ram 232, and hole 237 of the seat 235 in the housing 230. In this position, fluid may freely flow through the passage 231. The rails 244 of the blade 234 are engaged with a portion of the grooves 450 of seat 235.

In FIG. 10B, the ram 232 has advanced through channel 233 to engage the tubing 118. As shown in this view, the tubing 118 is pinched between the seat 235 and the blade 234 carried by the ram 232. A leading edge of the blade 234 and an opposing edge of the seat 234 create a pinch point P for cutting the tubing 118. The rails 244 of the blade 234 slidingly engage the grooves of the seat 235 as the blade 234 passes along the seat 235 to maintain the blade 234 in metal-to-metal sealing engagement with the seat 235.

The slanted shape of the hole 227 facilitates curving of the tubing 118 for severing by the blade 234. The tubing 118 is cut such that the bottom of the tubing drops away from the BOP 122 as indicated by the downward arrow.

FIG. 10C shows the ram 232 advanced to the extended position about channel 233. The ram 232 is advance such that the hole 227 of the ram 232 closes within the housing 230. The rails 244 of the blade 234 have advanced along the grooves 450 of the seat 235. The ram 232 may be retracted to reopen the passage 231, and the process repeated.

Figure 11:
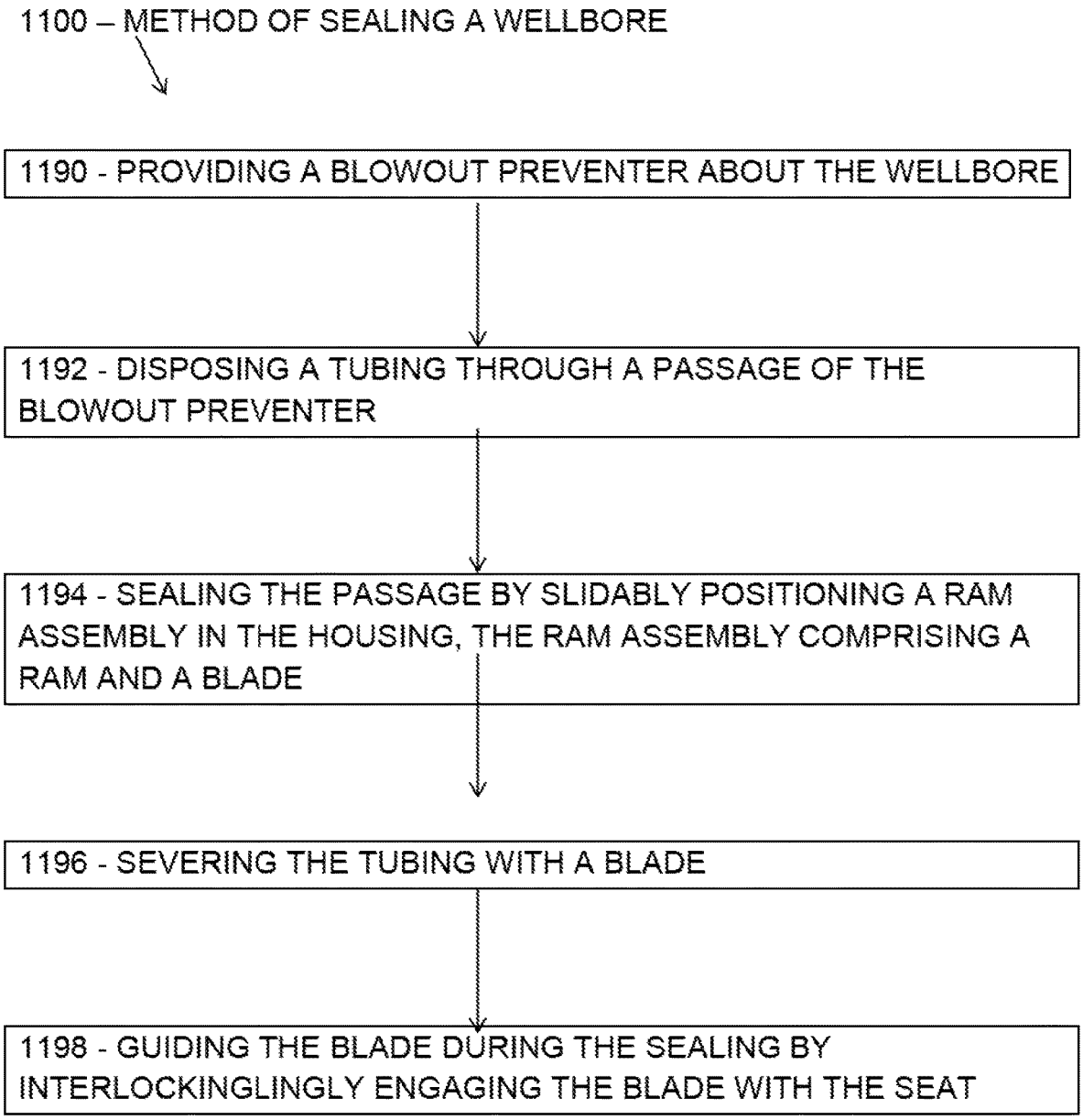
FIG. 11 is a flow chart depicting a method of sealing a wellbore.

FIG. 11 provides a method 1100 of sealing a wellbore. The method 1100 involves 1190—providing a blowout preventer about the wellbore. The blowout preventer may include the configurations provided herein. The method 1100 further involves 1192—disposing a tubing through a passage of the blowout preventer, 1194—sealing the passage by slidably positioning a ram assembly in the housing (the ram assembly comprising a ram and a blade), 1196—severing the tubing with a blade carried by the ram, and 1198—guiding the blade during the sealing by interlockinglingly engaging the blade and/or ram with the seat.

Portions of the methods may be performed in any order, or repeated as desired. Various combinations of the methods may also be provided.

It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the invention may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, one or more features of the ram assembly and/or blowout preventer may be provided to sever and/or seal the wellbore. While various configurations of the ram, blade, and/or seat are provided, various combinations of the features provided herein may be used. For example, various rails, seats, keys and/or groove configurations may be provided.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

Insofar as the description above and the accompanying drawings disclose any additional subject matter that is not within the scope of the claim(s) herein, the inventions are not dedicated to the public and the right to file one or more applications to claim such additional invention is reserved. Although a very narrow claim may be presented herein, it should be recognized the scope of this invention is much broader than presented by the claim(s). Broader claims may be submitted in an application that claims the benefit of priority from this application.

What is claimed is:

1. A ram assembly, comprising:

a ram wedge having a tubular cavity therethrough for receiving a tubular, the ram wedge configured to be slidably positionable in a ram channel of a housing and move between a retracted and an extended position relative to a passage in the housing;

a blade positionable about the tubular cavity, wherein the blade includes rails extending therefrom, wherein the blade is carried by the ram wedge to cuttingly engage the tubular;

a ram seat positionable in the housing about the passage, the ram seat having a hole for receiving the tubular therethrough, the ram seat having an outer surface interlockingly engageable with the rails as the ram wedge moves relative thereto whereby a gap is reduced therebetween; and a locking wedge configured to be positioned in the housing, the locking wedge having a surface engageable with a surface of the ram wedge.

2. The ram assembly of claim 1, wherein the locking wedge is one of fixed and movable.

3. A ram assembly, comprising:

a ram wedge having a tubular cavity therethrough for receiving a tubular, the ram wedge configured to be slidably positionable in a ram channel of a housing and move between a retracted and an extended position relative to a passage in the housing;

a blade positionable about the tubular cavity, wherein the blade includes rails extending therefrom, wherein the blade is carried by the ram wedge, and wherein the blade is configured to move with the ram wedge and in the same direction as the ram wedge as the ram wedge moves between the retracted and the extended positions to cuttingly engage the tubular; and a ram seat positionable in the housing about the passage, wherein the ram seat includes a hole for receiving the tubular therethrough, wherein the ram seat has an outer surface interlockingly engageable with the rails of the ram wedge as the ram wedge moves relative thereto whereby a gap is reduced therebetween.

4. The ram assembly of claim 3, further comprising a locking wedge configured to be positioned in the housing, wherein the locking wedge has a surface engageable with a surface of the ram wedge.

5. The ram assembly of claim 4, wherein the locking wedge is one of fixed and movable.

6. The ram assembly of claim 3, wherein the ram seat has a groove on the outer surface thereof engageable with the rails.

7. The ram assembly of claim 6, wherein the rails have tongues extending therefrom receivable by the groove.

8. The ram assembly of claim 3, wherein the rails and the ram seat have a tongue and groove interface therebetween.

9. The ram assembly of claim 8, wherein the tongue and groove interface is one of rectangular, slanted, dovetail, curved, and combinations thereof.

10. The ram assembly of claim 3, wherein the ram wedge is one of integral with and separate from the blade.

11. The ram assembly of claim 3, wherein the ram seat is one of circular and polygonal.

12. The ram assembly of claim 3, wherein the blade and the ram seat define a metal to metal seal therebetween.

13. A blowout preventer, comprising:

a housing including a passage for receiving a tubular and a ram channel therethrough; and at least one ram assembly, wherein the ram assembly comprises:

a ram wedge having a tubular cavity therethrough for receiving the tubular, wherein the ram wedge is slidably positioned in the ram channel of the housing and configured to move between a retracted and an extended position relative to the passage in the housing;

a blade positioned about the tubular cavity, wherein the blade includes rails extending therefrom, wherein the blade is carried by the ram wedge, and wherein the blade is configured to move with the ram wedge and in the same direction as the ram wedge as the ram wedge moves between the retracted and the extended positions to cuttingly engage the tubular; and a ram seat positioned in the housing about the passage, wherein the ram seat includes a hole for receiving the tubular therethrough, wherein the ram seat has an outer surface interlockingly engageable with the rails as the ram wedge moves relative thereto whereby a gap is reduced therebetween.

14. The blowout preventer of claim 13, further comprising actuators to extend and retract the ram wedge.

15. The blowout preventer of claim 13, further comprising at least one controller.

16. The blowout preventer of claim 13, wherein the ram wedge is one of integral with and separate from the blade.

17. The blowout preventer of claim 13, wherein the ram seat has a groove on the outer surface thereof engageable with the rails of the ram wedge.

18. The blowout preventer of claim 13, wherein the rails and the ram seat have a tongue and groove interface therebetween.

19. A method for sealing a wellbore, comprising:

providing a blowout preventer comprising a housing having a passage and a ram channel therethrough and at least one ram assembly, wherein the ram assembly comprises:

a ram wedge having a tubular cavity therethrough for receiving the tubular, wherein the ram wedge is slidably positioned in the ram channel of the housing and configured to move between a retracted and an extended position relative to the passage in the housing;

a blade positioned about the tubular cavity, wherein the blade has rails extending therefrom, wherein the blade is carried by the ram wedge, and wherein the blade is configured to move with the ram wedge and in the same direction as the ram wedge as the ram wedge moves between the retracted and the extended positions to cuttingly engage the tubular; and a ram seat positioned in the housing about the passage, wherein the ram seat includes a hole for receiving the tubular therethrough, wherein the ram seat has an outer surface interlockingly engageable with the rails of the ram wedge as the ram wedge moves relative thereto whereby a gap is reduced therebetween; and positioning the tubular through the passage, the tubular cavity and the hole; and forming a seal between the ram seat and the ram wedge by moving a ram shuttle and the ram wedge to the extended position.

20. The method of claim 19, wherein the ram wedge is one of integral with and separate from the blade.

* * * * *